US011135863B2

(12) United States Patent
Iijima et al.

(10) Patent No.: US 11,135,863 B2
(45) Date of Patent: Oct. 5, 2021

(54) CASSETTE PROVIDED WITH GUIDE FOR CORRECTING CURLING BEHAVIOR OF TAPE

(71) Applicant: BROTHER KOGYO KABUSHIKI KAISHA, Nagoya (JP)

(72) Inventors: Shota Iijima, Nagoya (JP); Arisa Noda, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 11 days.

(21) Appl. No.: 16/833,943

(22) Filed: Mar. 30, 2020

(65) Prior Publication Data

US 2020/0406655 A1 Dec. 31, 2020

(30) Foreign Application Priority Data

Jun. 28, 2019 (JP) ..... JP2019-121264

(51) Int. Cl.
*B41J 32/02* (2006.01)
*B41J 2/32* (2006.01)

(52) U.S. Cl.
CPC ..... *B41J 32/02* (2013.01); *B41J 2/32* (2013.01)

(58) Field of Classification Search
CPC ... B41J 32/02; B41J 2/32; B41J 3/4075; B41J 32/00; B41J 33/003; B41J 11/0005; B41J 15/044; B41J 15/046; B65H 2301/51256; B65H 2301/51214; B65H 23/34; B65H 2801/12
See application file for complete search history.

(56) References Cited

U.S. PATENT DOCUMENTS

2010/0123282 A1* 5/2010 Miyakoshi ..... H04N 1/00572 271/3.19
2010/0166475 A1 7/2010 Yamaguchi et al.
2010/0166477 A1 7/2010 Yamaguchi et al.
2010/0166478 A1 7/2010 Yamaguchi et al.
2010/0166479 A1 7/2010 Yamaguchi et al.
(Continued)

FOREIGN PATENT DOCUMENTS

EP 2 514 600 A1 10/2012
JP H05-162402 A 6/1993
(Continued)

OTHER PUBLICATIONS

The extended European Search Report for the related European Patent Application No. 20165659.2 dated Sep. 28, 2020.

*Primary Examiner* — Kristal Feggins
(74) *Attorney, Agent, or Firm* — Kenealy Vaidya LLP

(57) ABSTRACT

A cassette includes: a tape roll rotatable about an axis extending in a first direction; a tape conveying passage; and first and second guides positioned at the tape conveying passage. The tape roll is a roll of a tape. The tape is conveyed in a second direction perpendicular to the first direction along the tape conveying passage. The first guide and the second guide are configured to guide widthwise edges of the tape in the first direction. The first guide has a first end surface and the second guide has a second end surface facing the first end surface in the first direction. The first end surface and the second end surface provide a distance therebetween in the first direction smaller than a widthwise length of the tape in the first direction.

19 Claims, 9 Drawing Sheets

(56) References Cited

U.S. PATENT DOCUMENTS

| | | | | |
|---|---|---|---|---|
| 2010/0166480 | A1 | 7/2010 | Yamaguchi et al. | |
| 2011/0008090 | A1* | 1/2011 | Yamaguchi ..... | B65H 41/00 400/613 |
| 2013/0021622 | A1* | 1/2013 | Yamaguchi ..... | B41J 11/703 358/1.6 |
| 2018/0015740 | A1 | 1/2018 | Kodama et al. | |

FOREIGN PATENT DOCUMENTS

| | | | |
|---|---|---|---|
| JP | H06-179277 | A | 6/1994 |
| JP | H08-90879 | A | 4/1996 |
| JP | 2007-203521 | A | 8/2007 |
| JP | 2010-99852 | A | 5/2010 |
| JP | 2010-149434 | A | 7/2010 |

* cited by examiner

CASSETTE PROVIDED WITH GUIDE FOR CORRECTING CURLING BEHAVIOR OF TAPE

CROSS REFERENCE TO RELATED APPLICATION

This application claims priority from Japanese Patent Application No. 2019-121264 filed Jun. 28, 2019. The entire content of the priority application is incorporated herein by reference.

TECHNICAL FIELD

The present disclosure relates to a cassette attachable to a printer.

BACKGROUND

There has been known a cassette attachable to a printer. For example, Japanese Patent Application Publication No. 2010-149434 discloses a tape printer to which a tape cassette is attachable. In the tape cassette, a rolled tape is rotatably supported in a cassette case. Printing is performed on the tape by a thermal head, and then, the tape is ejected out of a tape ejection opening of the cassette case through a pair of restriction members. The ejected tape is discharged through a discharge slit of the tape printer.

SUMMARY

However, the tape may have curling tendency or curling behavior due to winding in the rolled shape. Therefore, in the above-described conventional tape printer, ejection of the tape through the discharge slit may not be performed if the tape having curling behavior is ejected through the tape ejection opening.

In view of the foregoing, it is an object of the disclosure to provide a cassette capable of correcting or curing curling nature of the tape for facilitating the tape discharge.

In order to attain the above and other objects, according to one aspect, the disclosure provides a cassette including a tape roll, a tape conveying passage, a first guide and a second guide. The tape roll is a roll of a tape and is rotatable about an axis extending in a first direction. The tape has a widthwise length in the first direction in a state of the tape roll. The tape has a first surface and a second surface opposite the first surface. The tape is conveyed in a second direction perpendicular to the first direction along the tape conveying passage. The first guide is positioned at the tape conveying passage and is configured to guide one widthwise edge of the tape in the first direction. The first guide has a first end surface. The second guide is positioned at the tape conveying passage and is configured to guide another widthwise edge of the tape in the first direction. The second guide has a second end surface facing the first end surface in the first direction. The first end surface and the second end surface provide a distance therebetween in the first direction smaller than the widthwise length of the tape.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
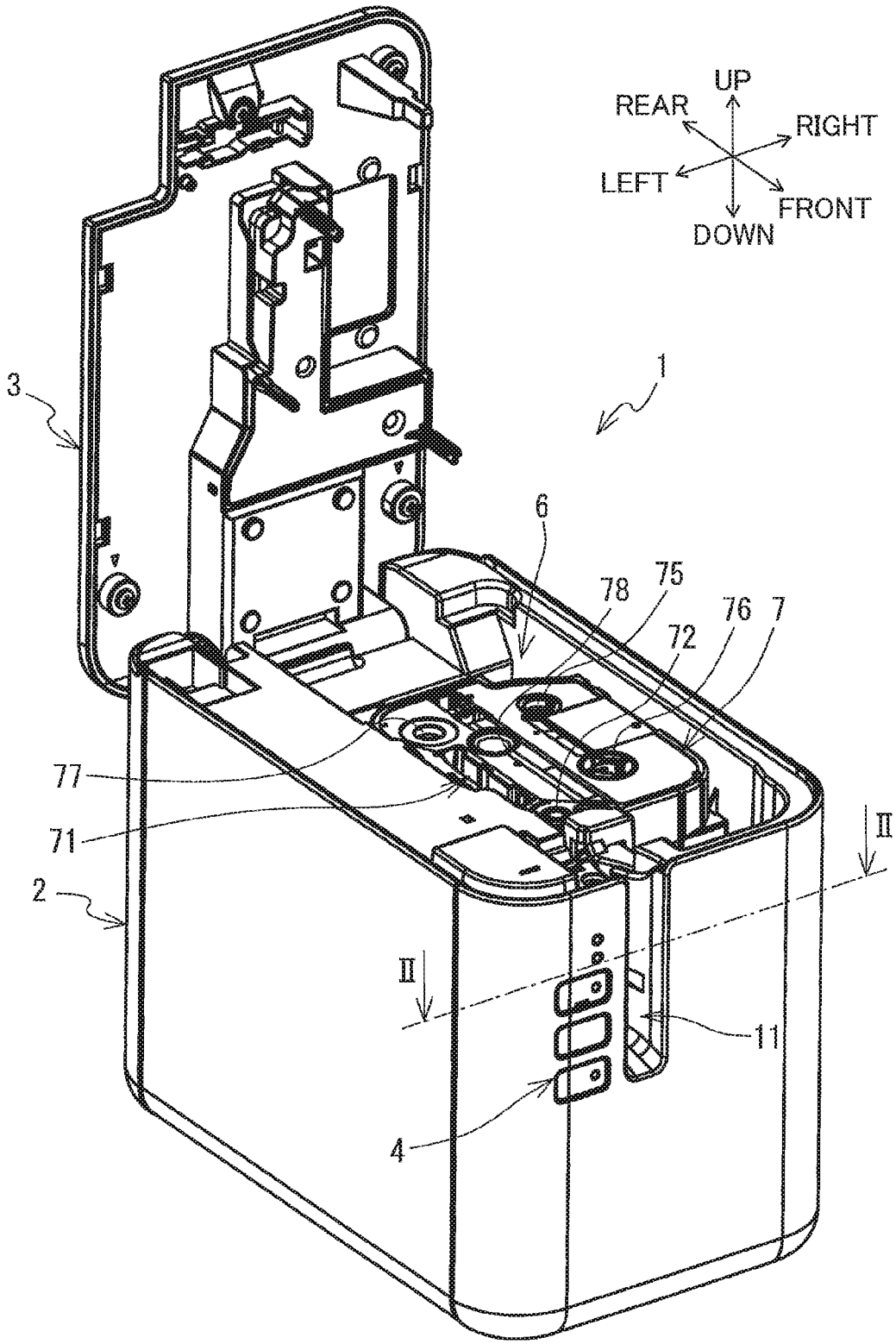
FIG. 1 is a perspective view of a printer to which a cassette 7 according to one embodiment of the disclosure is attached.

Hereinafter, a cassette 7 according to one embodiment of the present disclosure and a printer 1 to which the cassette 7 is attachable will be described with reference to accompanying drawings. Configurations of the cassette 7 illustrated in the drawings are merely exemplary and do not intend to limit the present disclosure.

In the following description, a diagonally lower left side, a diagonally upper right side, a diagonally lower right side, a diagonally upper left side, an upper side, and a lower side in FIG. 1 are respectively defined as a left side, a right side, a front side, a rear side, an upper side and a lower side of the printer 1 and the cassette 7 mounted in the printer 1.

As illustrated in FIG. 1, the printer 1 includes a housing 2, and a cover 3. The housing 2 has generally a rectangular parallelepiped in shape. The cover 3 is pivotally movably supported by an upper rear end portion of the housing 2 for opening and closing an upper open end of the housing 2. An input portion 4 is provided at a left-upper corner portion of a front surface of the housing 2. Various information can be inputted in the printer 1 by user's operations to the input portion 4. A discharge opening 11 is formed in the front surface of the housing 2 at a position rightward of the input portion 4. The discharge opening 11 extends in an upward/downward direction and allows an interior and an exterior of the housing 2 to communicate with each other.

Figure 2:
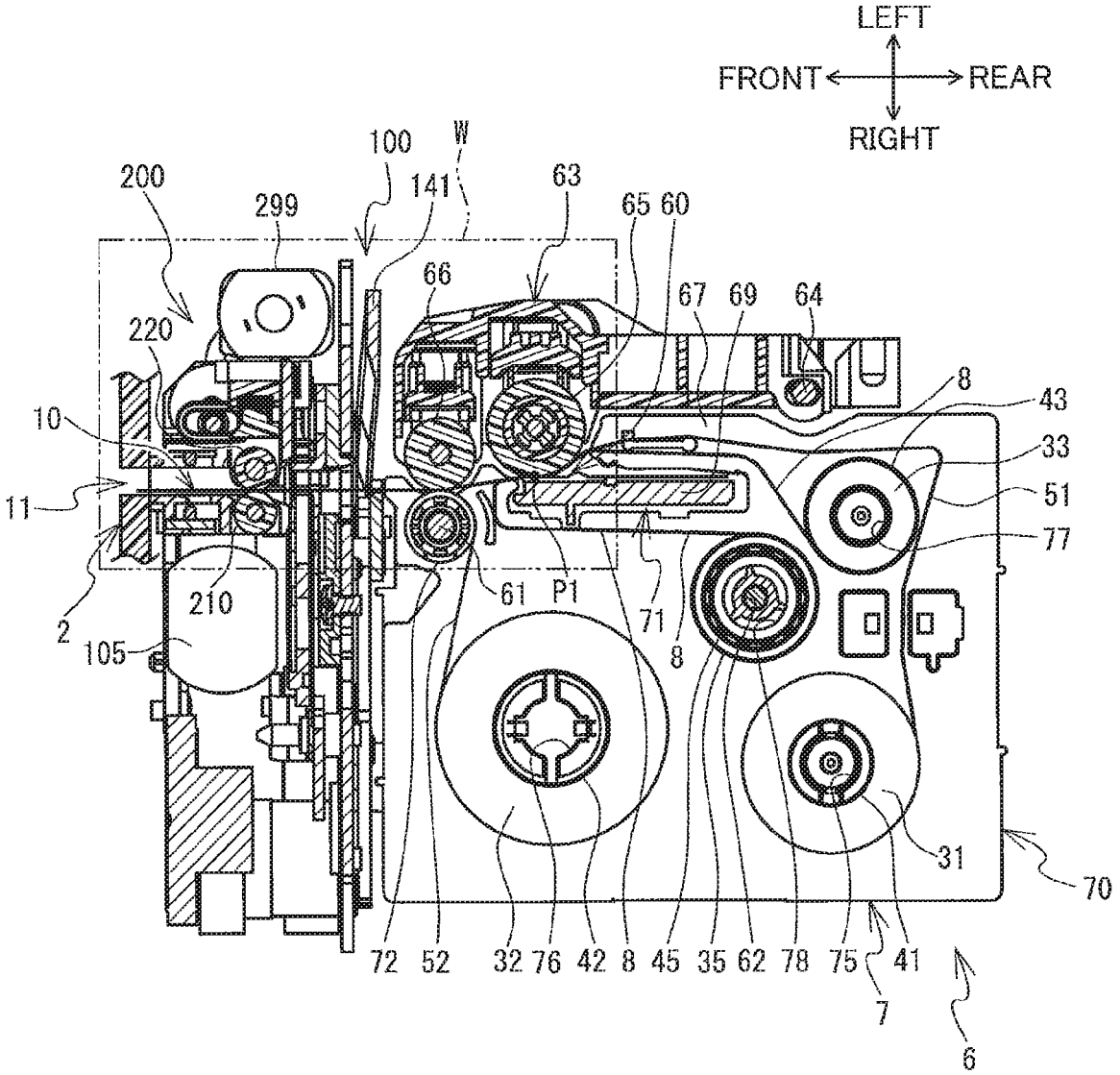
FIG. 2 is a cross-sectional view of the printer and the cassette 7 according to one embodiment taken along a line II-II in FIG. 1.

A cassette receiving portion 6 is provided at an upper portion of the housing 2. The cassette receiving portion 6 is recessed downward from an upper surface of the housing 2. The cassette 7 is attachable to and detachable from the cassette receiving portion 6. The cassette 7 rotatably holds a tape 10 (FIG. 2) and an ink ribbon 8 (FIG. 2). Each of the tape 10 and the ink ribbon 8 has a width in a widthwise direction coincident with the upward/downward direction in the drawings.

As illustrated in FIG. 2, the cassette receiving portion 6 includes a thermal head 60, a head holder 69, a tape drive shaft 61, a ribbon take-up shaft 62, and a drive motor (not illustrated).

The thermal head 60 is provided at a left surface of the head holder 69. The thermal head 60 includes a plurality of heat generating elements arrayed with one another in the upward/downward direction. The head holder 69 is positioned at a left portion of the cassette receiving portion 6, and has a plate-like shape extending in a direction perpendicular to a leftward/rightward direction (i.e., in a frontward/rearward direction).

The tape drive shaft 61 is positioned frontward of the head holder 69. The ribbon take-up shaft 62 is positioned rightward of the head holder 69. The tape drive shaft 61 and the ribbon take-up shaft 62 are rotatable each about an axis thereof extending in the upward/downward direction. The tape drive shaft 61 and the ribbon take-up shaft 62 are drivingly connected to the drive motor (not illustrated). The tape drive shaft 61 and the ribbon take-up shaft 62 are interlockingly rotatable upon rotations of the drive motor.

A platen holder 63 is positioned leftward of the cassette receiving portion 6. The platen holder 63 has a rear end portion provided with a shaft 64 extending in the upward/downward direction. The platen holder 63 is pivotally movable about an axis of the shaft 64. The platen holder 63 supports a platen roller 65 and a conveyer roller 66. The platen roller 65 and the conveyer roller 66 are rotatable about respective axes extending in the upward/downward direction.

The platen roller 65 faces the thermal head 60 from a left side thereof. The conveyer roller 66 is at a position frontward of the platen roller 65 and faces the drive shaft 61 from a left side thereof. The platen holder 63 is pivotally movable in the leftward/rightward direction about the axis of the shaft 64 between a proximity position (FIG. 2) and a remote position (not illustrated).

The platen roller 65 and the conveyer roller 66 are positioned close to the thermal head 60 and the tape drive shaft 61, respectively, at the proximity position of the platen holder 63. The platen roller 65 and the conveyer roller 66 are positioned leftward away from the thermal head 60 and the tape drive shaft 61, respectively, at the remote position of the platen holder 63. The platen roller 65 is switchable to a drive-connection state to the drive motor in accordance with the pivotal movement of the platen holder 63 from the remote position to the proximity position. A position nipped between the platen roller 65 and the thermal head 66 when the platen holder 63 is at the proximity position will be referred to as "printing position P1" as depicted in FIGS. 2 and 3.

Figure 3:
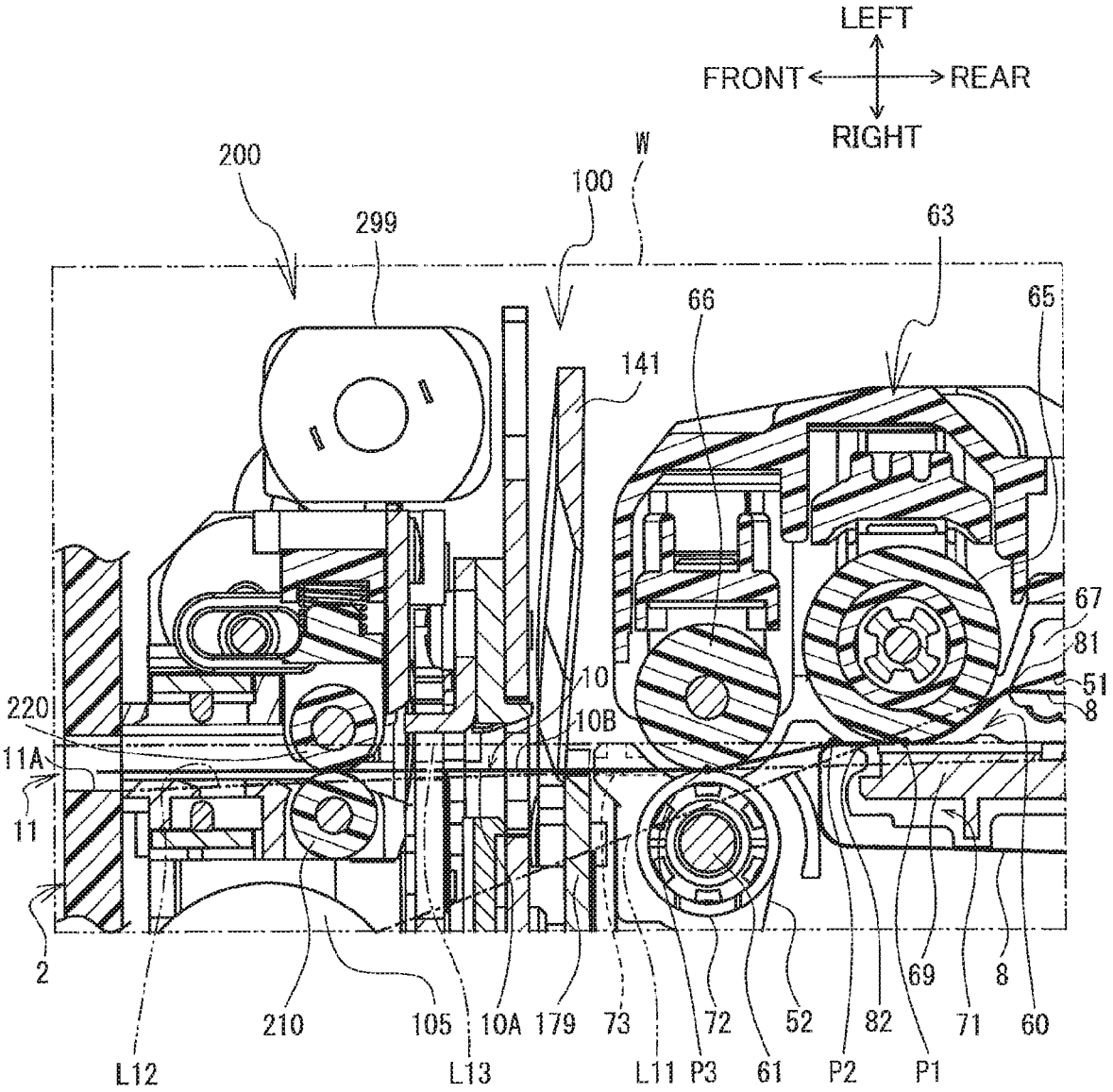
FIG. 3 is an enlarged cross-sectional view illustrating a region W in FIG. 2.

As illustrated in FIG. 3, a cutter unit 100 is provided inside the housing 2 at a position adjacent to and rearward of the discharge opening 11. The cutter unit 100 includes a fixed blade 179, a movable blade 141, and a cutter motor 105. The fixed blade 179 and the movable blade 141 are plate-like shaped each having a thickness in the frontward/rearward direction.

The fixed blade 179 is fixed at a position rightward of the tape 10 discharged out of the cassette 7. The fixed blade 179 has a left end having a blade edge extending in the upward/downward direction. The movable blade 141 has a right end having a blade edge extending in the upward/downward direction. The movable blade 141 has a lower end portion connected to a shaft member (not illustrated) extending in the frontward/rearward direction. The movable blade 141 is pivotally movable about an axis of the shaft member.

The movable blade 141 is drivingly connected to the cutter motor 105. Upon energization of the cutter motor 105, the blade edge of the movable blade 141 and the blade edge of the fixed blade 179 nip the tape 10 therebetween. Hence, the cutter unit 100 can cut the tape 10.

A discharge unit 200 is provided between the discharge opening 11 and the cutter unit 100 in the frontward/rearward direction. The discharge unit 200 includes a first roller 210, a second roller 220 and a discharge motor 299. The first roller 210 and the second roller 220 are arranged adjacent to each other in the leftward/rightward direction. The second roller 220 is positioned leftward of the first roller 210. The first roller 210 and second roller 220 are rotatable about respective axes extending in the upward/downward direction. The first roller 210 and the second roller 220 are configured to nip the tape 10 therebetween in the leftward/rightward direction.

The discharge motor 299 is drivingly connected to the second roller 220. The second roller 220 is configured to start rotating upon energization of the discharge motor 299. Following the rotation of the second roller 220, the first roller 210 is rotatable. Accordingly, the tape 10 is configured to be conveyed toward the discharge opening 11 by the rotations of the second roller 220 and the first roller 210 while being nipped between the first roller 210 and the second roller 220.

Figure 4:
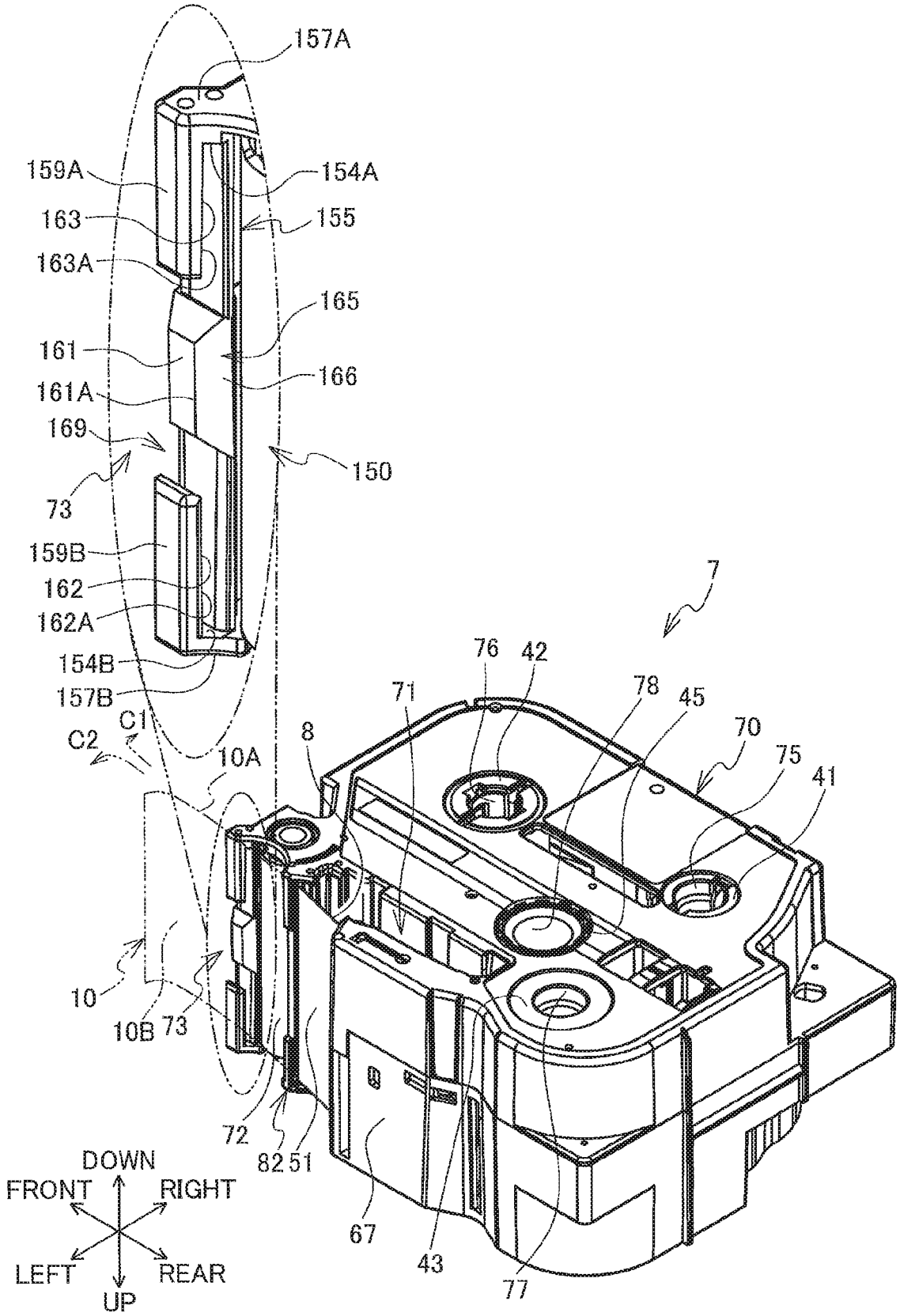
FIG. 4 is a perspective view of the cassette 7 according to the embodiment.

Next, the cassette 7 will be described with reference to FIGS. 2 and 4. In FIGS. 2 and 4, the tape 10 is indicated by a two-dotted chain line for better understanding to the drawings.

The cassette 7 is a laminate type cassette. The cassette 7 includes a case 70, an ejecting portion 73, and a guide 150. The case 70 is box shaped, and accommodates therein a tape drive roller 72, a first tape spool 41, a second tape spool 42, a ribbon spool 43, and a ribbon take-up spool 45. Further, the case 70 is formed with support holes 75, 76, 77, 78 those extending throughout a thickness of the case 70 in the upward/downward direction.

The tape drive roller 72 is positioned at a left front corner portion of the case 70, and has a hollow cylindrical shape extending in the upward/downward direction. The tape drive roller 72 is rotatably supported by the case 70. The tape drive shaft 61 is insertable into a hollow space of the tape drive roller 72.

The support hole 75 rotatably supports the first tape spool 41. A transparent film tape 51 is wound over the first tape spool 41 to constitute a first tape roll 31. The transparent film tape 51 is configured to be paid out from the first tape roll 31 by the rotation of the first tape roll 31 along with the rotation of the first tape spool 41 about an axis thereof extending in the upward/downward direction. That is, the first tape roll 31 is rotatable about the axis of the first tape spool 41.

The support hole 76 rotatably supports the second tape spool 42. A double-coated adhesive tape 52 is wound over the second tape spool 42 to constitute a second tape roll 32. The double-coated adhesive tape 52 is a double-sided tape whose one surface is covered with a release sheet. The double-coated adhesive tape 52 is configured to be paid out from the second tape roll 32 by the rotation of the second tape roll 32 along with the rotation of the second tape spool 42 about an axis thereof extending in the upward/downward direction. That is, the second tape roll 32 is rotatable about the axis of the second tape spool 42. The double-coated adhesive tape 52 has a tip end connected to the tape drive roller 72.

The support hole 77 rotatably supports the ribbon spool 43. A new or non-used ink ribbon 8 is wound over the ribbon spool 43 to constitute a ribbon roll 33. The ink ribbon 8 is configured to be paid out from the ribbon roll 33 by the rotation of the ribbon roll 33 along with the rotation of the ribbon spool 43 about an axis thereof extending in the upward/downward direction.

The support hole 78 rotatably supports the ribbon take-up spool 45. A used ink ribbon 8 is wound over the ribbon take-up spool 45 to constitute a ribbon take-up roll 35. The used ink ribbon 8 is configured to be wound over the ribbon take-up roll 35 by the rotation of the ribbon take-up rol 35 along with the rotation of the ribbon take-up spool 45 about an axis thereof extending in the upward/downward direction.

The ejecting portion 73 is at a left end portion and a front end portion of the case 70. The ejecting portion 73 is open in the frontward/rearward direction, and is configured to allow the tape 10 to be ejected therethrough toward the cutter unit 100. The guide 150 is provided at the ejecting portion 73. Details of the guide 150 will be described later.

A head opening 71 is provided in the case 70. The head opening 71 is an open area extending in the frontward/rearward direction and throughout the thickness of the case 70 in the upward/downward direction. The head opening 71 is open leftward. The thermal head 60 is insertable in the head opening 71.

Specifically, the case 70 has a left side portion provided with an arm portion 67 extending in the frontward/rearward direction. The arm portion 67 has a right side surface forming apart of the head opening 71. A first tape guide 81 (FIG. 3) is provided at a front end portion of the arm portion 67. The first tape guide 81 is an opening portion through which the ink ribbon 8 and the transparent film tape 51 (the transparent film tape 51 is positioned on the left of the leftward of the ink ribbon 8) are discharged.

The transparent film tape 51 and the ink ribbon 8 those discharged out of the first tape guide 81 are configured to pass through the head opening 71, and then directed toward a second tape guide 82. The second tape guide 82 is an opening portion positioned between the head opening 71 and the tape drive roller 72.

In the case 70, the ink ribbon 8 is separated from the transparent film tape 51 and is directed rightward at a portion between the second tape guide 82 and the tape drive roller 72. The ink ribbon 8 is then wound over the ribbon take-up roll 35. In the following description, the position at which the ink ribbon 8 is separated from the transparent film tape 51 will be referred to as "peeling position P2" (see FIG. 3). The peeling position P2 is at a position between the second tape guide 82 and the tape drive roller 72.

The transparent film tape 51 positioned forward of the peeling position P2 (after the ink ribbon 8 is peeled off) is directed to the tape drive roller 72 where the transparent film tape 51 is superposed with a left surface of the double-coated adhesive tape 52. In the attached state of the cassette 7 to the cassette receiving portion 6, the double-coated adhesive tape 52 and the transparent film tape 51 are nipped between the tape drive roller 72 and the conveyer roller 66 for sticking to each other.

In the following description, the position at which the double-coated adhesive tape 52 and the transparent film tape 51 are stuck to each other will be referred to as "sticking position P3" (see FIG. 3). A combination of the transparent film tape 51 and the double-coated adhesive tape 52 will be called as the "tape 10". Incidentally, the double-coated adhesive tape 52, the transparent film tape 51, and the tape 10 (the combination of the transparent film tape 51 and double-coated adhesive tape 52) will be occasionally and generically referred to as "tape" of the disclosure. In the cassette 7 according to the embodiment, the double-coated adhesive tape 52 has rigidity higher than rigidity of the transparent film tape 51. Rigidity of the tape 10 varies depending on materials of the tape 10, and also depending on a shape or configuration of the tape 10 such as a width of the tape 10, a thickness of the tape 10, and presence/absence of surface irregularities of the tape 10.

Upon energization of the drive motor and the discharge motor 299, the platen roller 65, the tape drive roller 72, the conveyer roller 66, the first roller 210, and the second roller 220 convey the tape 10 and the ink ribbon 8. In the following description, a conveying direction of the tape 10 at a range from the first tape guide 81 to the discharge opening 11 will be referred to as "conveying direction". The conveying direction is generally the frontward/rearward direction. Hence, an upstream side in the conveying direction is a rearward direction, and a downstream side in the conveying direction is a frontward direction.

In FIG. 3, a first linear line L11, a second linear line L12, and a third linear line L13 are shown. The first linear line L11 extends through the first tape guide 81 and the second tape guide 82. The second linear line L12 extends through the sticking position P3 and one end (right end) 11A of the discharge opening 11. The one end 11A is positioned slightly rightward of the sticking position P3. Hence, the second linear line L12 is slightly inclined with respect to the frontward/rearward direction. The third linear line L13 extends through the printing position P1 and the peeling position P2, and generally extends in the frontward/rearward direction.

A structure of the guide 150 of the cassette 7 will be described next with reference to FIGS. 4 and 5.

The guide 150 is provided at the ejecting portion 73 which is a part of a tape conveying passage. The guide 150 is configured to guide the tape 10 toward the downstream side in the conveying direction. Here, the terms "tape conveying passage" is generally established by the first tape guide 81, the second tape guide 82, and the ejecting portion 73 along which the tape 10 is conveyed. Further, the term "guide" implies not only a concept of restraining a conveying item (the tape 10 in the embodiment) from being offset from a predetermined region, but also a concept of positively contacting with the conveying item to deform the same.

Figure 5:
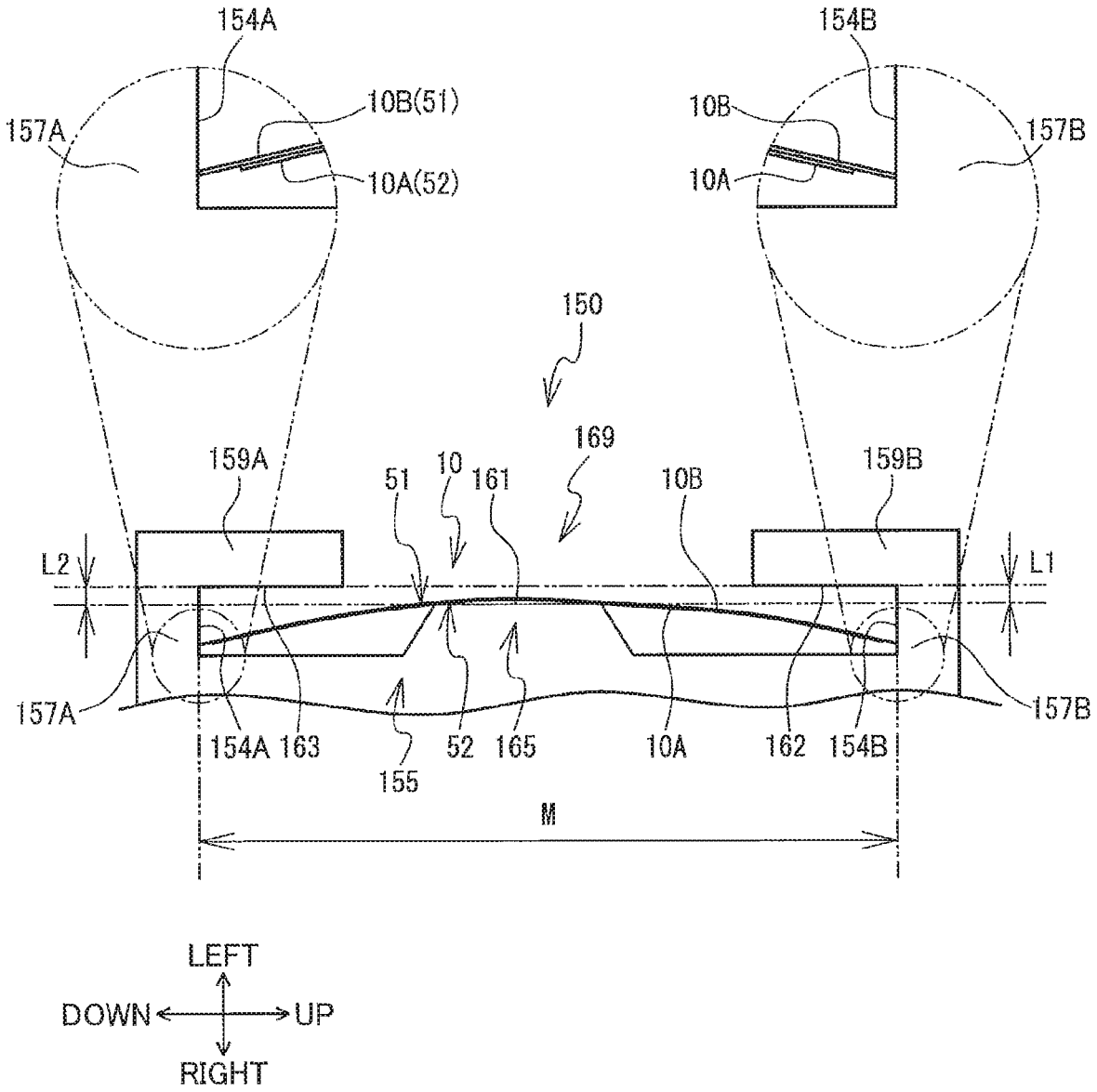
FIG. 5 is a front view illustrating a guide 150 in the cassette 7 according to the embodiment.

Incidentally, in FIG. 5, the tape 10 to be conveyed is configured of the double-coated adhesive tape 52 and the transparent film tape 51 stuck to the adhesive surface of the double-coated adhesive tape 52. Further, the transparent film tape 51 has a widthwise length (hereinafter, occasionally referred to as "tape width") is slightly greater than a widthwise length of the double-coated adhesive tape 52 in a winding state.

The guide 150 includes a base 155, a base-protrusion 165, a pair of extension portions 157A and 157B, and a pair of arms 159A and 159B. The base 155 extends in the upward/downward direction, and is positioned at a left end portion of the ejecting portion 73. The base-protrusion 165 protrudes leftward from a generally center portion of the base 155 in the upward/downward direction. The base-protrusion 165 has a generally trapezoidal shape in a side view. The base-protrusion 165 has a first region 161 and a sloped region 166.

The first region 161 is a flat left end surface of the base-protrusion 165. That is, the first region 161 is a top surface of the trapezoidal shape of the base-protrusion 165. The first region 161 is contactable with one surface of the tape 10. In the following description, one surface of the tape 10 in contact with the first region 161 will be referred to as a "first surface 10A", and a surface opposite to the first surface 10A will be referred to as a "second surface 10B". In the depicted embodiment, the first surface 10A is a right surface of the tape 10 (that is, a right surface of the double-coated adhesive tape 52), and the second surface 10B is a left surface of the tape 10 (that is, a left surface of the transparent film tape 51).

The sloped region 166 is a sloped surface extending diagonally frontward and leftward from the generally center portion of the base 155. The sloped region 166 is connected to an upstream end (rear end) 161A of the first region 161 in the conveying direction. The sloped region 166 is inclined relative to the conveying direction to extend leftward toward downstream in the conveying direction. Put different way, the sloped region 166 is inclined rearward with increasing the distance from the upstream end 161A. The sloped region 166 is contactable with the first surface 10A and is configured to guide the tape 10 to the first region 161.

Each of the pair of extension portions 157A and 157B extends leftward from each end of the base 155 in the upward/downward direction. The extension portions 157A and 157B are positioned at the ejecting portion 73 and frontward of the head opening 71 (i.e., downstream in the conveying direction). Each of the extension portions 157A and 157B has a flat end face facing with each other in the upward/downward direction. An end face 154A facing upward of the lower extension portion 157A and an end face 154B facing downward of the upper extension portion 157B function as a pair of guide regions 154A and 154B for guiding widthwise edges (upper and lower edges) of the tape 10.

A minimum distance between the pair of guide regions 154A and 154B (distance M in FIG. 5) is slightly smaller than the widthwise length of the transparent film tape 51 rolled in the form of the first tape roll 31. Hence, the tape 10 is curved in an arcuate shape within the guide 150 such that a widthwise center portion of the tape 10 is positioned leftward of a remaining portion of the tape 10, since the base-protrusion 165 protrudes leftward. In other words, the tape 10 is deformed leftward into a convex shape within the guide 150. This deforming direction (leftward direction) of the tape 10 will be referred to as "curving direction".

Each of the pair of arms 159A and 159B extends toward each other from a left end of the corresponding one of the extension portions 157A and 157B. Each of the arms 159A and 159B is positioned outward of the base-protrusion 165 in the upward/downward direction. In other words, the arms 159A and 159B are arrayed with each other with a space 169 therebetween in the upward/downward direction. That is, the arms 159A and 159B are positioned spaced away from each other in the upward/downward direction. The space 169 is open leftward. That is, the space 169 is open in the leftward direction which is coincident with the direction in which the first region 161 faces.

In the following description, a right end surface 162 of the upper arm 159B will be referred to as a "second region 162", and a right end surface 163 of the lower arm 159A will be referred to as a "third region 163". The second region 162 and the third region 163 are flat planes contactable with the second surface 10B of the tape 10. Leftward/rightward positions of the second region 162 and the third region 163 are generally coincident with each other. The second region 162 is connected to the upper guide region 154B, and the third region 163 is connected to the lower guide region 154A. In other words, the second region 162 is positioned above the first region 161, and the third region 163 is positioned below the first region 161.

Further, the second region 162 and the third region 163 are positioned leftward of the first region 161. In other words, the guide 150 is configured such that the first region 161 is positioned rightward of the second region 162 and the third region 163.

The thickness direction of the tape 10 positioned in the guide 150 is coincident with the leftward/rightward direction. Referring to FIG. 5, a first distance L1 between the first region 161 and the second region 162 in the leftward/rightward direction is substantially equal to a second distance L2 between the first region 161 and the third region 163 in the leftward/rightward direction. For example, the first distance L1 and the second distance L2 is 1 mm. These distances L1 and L2 may be properly changed.

The first region 161 is overlapped with the second region 162 and the third region 163 in the conveying direction. Further, the upstream end 161A of the first region 161 is positioned frontward (downstream in the conveying direction) of an upstream end 162A of the second region 162 and an upstream end 163A of the third region 163. Further, as illustrated in FIG. 3, at the ejecting portion 73, the first region 161 is positioned leftward of the first linear line L11 and the second linear line L12, and rightward of the third linear line L13.

Next, a printing process to be performed in the printer 1 will next be described with reference to FIGS. 1 through 5.

In the open state of the cover 3, the platen holder 63 is at the remote position. When the cassette 7 is attached to the cassette receiving portion 6 by a user with the cover 3 in the open state, the ribbon take-up shafl 62 is inserted in the ribbon take-up spool 45, and at the same time, the tape drive shaft 61 is inserted in the tape drive roller 72, and the head holder 69 is inserted in the head opening 71.

Then, the platen holder 63 moves from the remote position to the proximity position in association with closing of the cover 3. As a result, the platen roller 65 is pressed against the thermal head 60 with the ink ribbon 8 and the transparent film tape 51 interposed between the platen roller 65 and the thermal head 60. The conveyer roller 66 is pressed against the tape drive roller 72 with the double-coated adhesive tape 52 and the transparent film tape 51 interposed between the conveyer roller 66 and the tape drive roller 72.

Then, the drive motor is powered, so that the tape drive shaft 61, the platen roller 65, and the ribbon take-up shaft 62 rotate. The tape drive roller 72 is rotationally driven by the rotation of the tape drive shaft 61, and the conveyer roller 66 is rotated by the rotation of the tape drive roller 72. Hence, the double-coated adhesive tape 52, the transparent film tape 51, and the ink ribbon 8 are conveyed.

The double-coated adhesive tape 52 is paid out from the second tape roll 32. The transparent film tape 51 is paid out from the first tape roll 31. At the same time, the ink ribbon 8 is paid out from the ribbon roll 33. The transparent film tape 51 and the ink ribbon 8 are ejected through the first tape guide 81 and are directed to the printing position P1 by the rotation of the drive motor.

Ink contained in the ink ribbon 8 is transferred to the transparent film tape 51 by the heat generated at the thermal head 60, whereupon a character is printed on the transparent film tape 51 positioned at the printing position P1. Letters, figures, numerals, and marks are example of the character. The transparent film tape 51 and the used ink ribbon 8 are conveyed toward the second tape guide 82 by the rotation of the platen roller 65 and the ribbon take-up shaft 62.

After the ink ribbon 8 is entered into the second tape guide 82, the ink contained in the ink ribbon 8 is released from the ink ribbon 8 by the separation of the ink ribbon 8 from the transparent film tape 51 at the peeling position P2. The used ink ribbon 8 moved past the peeling position P2 is wound over the ribbon take-up roll 35 rotated by the ribbon take-up shaft 62. The printed transparent film tape 51 moved past the peeling position P2 is directed to the sticking position P3 by the rotation of the conveyer roller 66 and the tape drive roller 72.

At the sticking position P3, one surface of the double-coated adhesive tape 52 is stuck to the transparent film tape 51 moved past the second tape guide 82. Hence, the tape 10 is provided at the sticking position P3. The tape 10 is conveyed to the ejecting portion 73.

The tape 10 reaching the ejecting portion 73 is guided leftward and toward downstream side in the conveying direction by the sloped region 166 of the guide 150, and the tape 10 arrives at the space 169. At this time, the first surface 10A of the tape 10 is in contact with the first region 161. Further, the second region 162 and the third region 163 restrain the second surface 10A of the tape 10 from moving leftward.

Here, the transparent film tape 51 in the winding form over the first tape spool 41 has a length in the upward/downward direction (i.e., widthwise length of the tape 10) that is greater than the distance M between the pair of guide regions 154A and 154B in the upward/downward direction. Therefore, each widthwise edge of the tape 10 contacts with corresponding one of the guide regions 154A and 154B, and hence, the position of each widthwise edge of the tape 10 in the upward/downward direction is regulated or determined by each of the guide regions 154A and 154B. That is, the tape 10 is regulated to pass through a generally center portion of the guide 150 in the upward/downward direction.

Further, the tape 10 contacts the sloped region 166 and the first region 161 while the position in the upward/downward direction of the tape 10 is restricted by the pair of guide regions 154A and 154B. Hence, the tape 10 is deformed to be convex leftward (i.e., deformed in the curving direction). That is, in an area between the pair of extension portions 157A and 157B, the tape 10 is deformed to be convex toward the transparent film tape 51 in an overlapping state between the double-coated adhesive tape 52 and the transparent film tape 51, as illustrated in FIG. 5.

The transparent film tape 51 and the double-coated adhesive tape 52 are initially wound over the first tape spool 41 and the second tape spool 42 to form the first tape roll 31 and the second tape roll 32, respectively. Hence, in a state where the transparent film tape 51 and the double-coated adhesive tape 52 are stuck to each other, restoration force for restoring originally winding shape is applied to the tape 10. In other words, the force for curving the tape 10 in thickness directions thereof is generated in the tape 10 as the tape 10 is conveyed toward the downstream side in the conveying direction. This curving behavior of the tape 10 will be referred to as "curling".

Specifically, a first force C1 (FIG. 4) directing rightward is applied to the tape 10 as the tape 10 extends toward the downstream side in the conveying direction by restoration of inherent winding shape of the transparent film tape 51. On the other hand, a second force C2 (FIG. 4) directing leftward is applied to the tape 10 as the tape 10 extends toward the downstream side in the conveying direction by restoration of inherent winding shape of the double-coated adhesive tape 52. The second force C2 is greater than the first force C1, since the rigidity of the double-coated adhesive tape 52 is higher than that of the transparent film tape 51.

Accordingly, the tape 10 is likely to be curled in a direction of the second force C2. That is, curling is generated in the tape 10 such that the second surface 10B is an inner periphery of the curl. According to the embodiment, the tape 10 is deformed to be convex in the curving direction (leftward) while the tape 10 moves past the guide 150, the curling behavior of the tape 10 can be cured or corrected by the guide 150 into a flat posture generally parallel to the frontward/rearward direction.

The tape 10 moved past the ejecting portion 73 passes through the cutter unit 100, and is entered into a portion between the first roller 210 and the second roller 220 in the discharge unit 200. In the discharge unit 200, the tape 10 is conveyed toward the discharge opening 11 by the rotation of the discharge motor 299. After stopping the rotation of the drive motor and the discharge motor 299, the cutter motor 105 is energized, so that the tape 10 is cut by the cutter unit 100. The user can takeout a cut segment of the printed tape 10 through the discharge opening 11.

As described above, the cassette 7 includes the first tape roll 31, the tape conveying passage, and the pair of extension portions 157A and 157B. The first tape roll 31 is a roll of the transparent film tape 51 constituting the tape 10, and is rotatable about the axis extending in the upward/downward direction. The tape conveying passage includes the first tape guide 81, the second tape guide 82, and the ejecting portion 73 for conveying the tape 10 in the conveying direction (frontward/rearward direction) perpendicular to the upward/downward direction.

The pair of extension portions 157A and 157B is positioned at the ejecting portion 73 and provides the pair of guide regions 154A and 154B. The guide region 154A of the lower extension portion 157A is positioned at the tape conveying passage, and is configured to guide the lower edge of the tape 10 (i.e., the lower edge of the transparent film tape 51 having wider width than the double-coated adhesive tape 52). The guide region 154B of the upper extension portion 157B is positioned at the tape conveying passage, and is configured to guide the upper edge of the tape 10 (i.e., the upper edge of the transparent film tape 51 having wider width than the double-coated adhesive tape 52).

The distance M in the upward/downward direction between the pair of guide regions 154A and 154B is smaller than the widthwise length of the transparent film tape 51 constituting the first tape roll 31.

With this structure, because of the difference between the distance M and the widthwise length of the tape 10 (or the widthwise length of the transparent film tape 51), the tape 10 is guided by the lower and upper guide regions 154A and 154B and is shaped into the curved shape against the curing behavior of the tape 10. In other words, the curved shape includes a central mountain top portion and skirt portions, and the mountain top portion prevents the tape 10 from curling. Accordingly, the cassette 7 can discharge the tape 10 whose curling behavior is cured or corrected. Since the tape 10 is deformed into a convex shape whose convex is oriented in the curving direction (leftward) at the ejecting portion 73, the curling behavior of the tape 10 can be cured. Accordingly, the tape 10 discharged from the ejecting portion 73 becomes a flat shape extending approximately parallel to the frontward/rearward direction. Consequently, the guide 150 can stably guide the tape 10 without any stagnation or jamming.

The pair of arms 159A and 159B is provided at the ejecting portion 73 of the tape conveying passage for guiding the surface of the tape 10 (or the transparent film tape 51). The arms 159A and 159B and the base-protrusion 165 are displaced from each other in the leftward/rightward direction and in the upward/downward direction. Hence, the deformed tape 10 in a curved shape is less likely to contact the pair of arms 159A and 159B. Therefore, control to the degree of curvature of the tape 10 can be facilitated.

Further, the pair of arms 159A and 159B is also provided at the ejecting portion 73 to guide the second surface 10B of the tape 10. Since the lower arm 159A and the upper arm 159B are spaced away from each other in the upward/downward direction, the deformed tape 10 in the curved shape is unlikely to contact the arms 159A and 159B. Therefore, curved shape of the tape 10 can be maintained easily.

Further, the tape 10 includes the double-coated adhesive tape 52 and the transparent film tape 51. The double-coated adhesive tape 52 has the adhesive surface, and the transparent film tape 51 is stuck to the adhesive surface. The transparent film tape 51 has the widthwise length greater than that of the double-coated adhesive tape 52. With this structure, even if dust or foreign particles may hover around the ejecting portion 73, the cassette 7 can prevent the double-coated adhesive tape 52 from being adhered with the dust or foreign particles, since the adhesive surface which is the one surface of the tape 10 is covered with the transparent film tape 51. Consequently, the tape 10 can be properly discharged.

The tape 10 is deformed into the convex shape toward the transparent film tape 51 by the contact with the pair of extension portions 157A and 157B with a state that the double-coated adhesive tape 52 and the transparent film tape 51 are overlapped with each other. That is, the adhesive surface of the tape 10 is covered with the transparent film tape 51, even if dust or foreign particles may hover around the ejecting portion 73. Therefore, the cassette 7 can properly discharge the tape 10 that is deformed into the convex shape toward the transparent film tape 51.

Further, since the pair of extension portions 157A and 157B is positioned downstream of the head opening 71 in the conveying direction, the cassette 7 can properly discharge the tape 10 at the position downstream of the head opening 71 into which the thermal head 60 is insertable.

Further, the pair of extension portions 157A and 157B is positioned at the ejecting portion 73. Therefore, the cassette 7 can properly discharge the tape 10 at the ejecting portion 73.

Further, the sloped region 166 is connected to the upstream end 161A of the first region 161 of the base-protrusion 165, and the sloped region 166 is sloped leftward (i.e., in a direction from the first surface 10A to the second surface 10B of the tape 10 at the guide 150) toward downstream in the conveying direction. Accordingly, tape 10 can be easily guided by the sloped region 166 to the first region 161.

Due to the inherent curing nature of the tape 10, the tape 10 is urged to form a curl with the second surface 10B forming the inner peripheral surface of the curl. Since the pair of arms 159A and 159B can contact the inner peripheral surface of the curl (second surface 10B), the curling of the tape 10 can be easily corrected or cured.

The double-coated adhesive tape 52 paid out from the second tape spool 42 is overlapped with the transparent film tape 51 paid out from the first tape spool 41 to form the tape 10. The second surface 10B of the tape 10 is the outer surface of the transparent film tape 51 whose rigidity is lower than the rigidity of the double-coated adhesive tape 52 in the embodiment. However, the second surface 10B of the tape 10 may be the outer surface of the double-coated adhesive tape 52, provided that the rigidity of the double-coated adhesive tape 52 is lower than the rigidity of the transparent film tape 51. That is, the second surface 10B of the tape 10 is an outer surface of the transparent film tape 51 or double-coated adhesive tape 52 whose rigidity is lower than the rigidity of the other. Curling of the tape 10 with the second surface 10B forming the inner surface of the curl can be restricted, since the tape 10 is guided by at least the pair of extension portions 157A and 157B.

The guide regions 154A and 154B of the extension portions 157A and 157B are in contact with the lower and upper edges of the tape 10, respectively. Further, the pair of extension portions 157A and 157B is connected to the pair of arms 159A and 159B, respectively. With this structure, the tape 10 can be properly discharged, because the tape 10 is guided by the pair of extension portions 157A and 157B and the pair of arms 159A and 159B.

The second region 162 of the upper arm 159B and the third region 163 of the lower arm 159A are arrayed with each other with the space 160 interposed therebetween in the upward/downward direction. The space 169 is open leftward, that is, the space 169 is open in the direction in which the first region 161 faces (facing direction of the first region 161). The facing direction is coincident with the direction from the first surface 10A to the second surface 10B of the tape 10 that is conveyed between the lower guide region 154A and the upper guide region 154B. The space 169 between the pair of arms 159A and 159B can facilitate guiding of the tape 10 by the pair of arms 159A and 159B.

The present disclosure is not limited to the above described embodiment.

For example, a receptor type cassette or a thermal type cassette is available, instead of the laminate type cassette 7. Regarding the receptor type cassette (hereinafter simply referred to as a "first cassette"), a receptor tape (hereinafter simply referred to as a "tape 12") is wound over the first tape spool 41 supported by the support hole 75, the second tape spool 42 is not provided, and the ribbon spool 43 is supported by the support hole 77. Regarding the thermal type cassette, a heat sensitive tape or a stencil tape is wound over the first tape spool 41 supported by the support hole 75, and the second tape spool 42 and the ribbon spool 43 are not provided.

In other words, the cassette of the disclosure may include at least one roll of a tape to which printing is to be performed. In a case where the cassette of the disclosure is a laminate type cassette such as the cassette 7 of the depicted embodiment, not only the transparent film tape 51 (i.e., the first tape roll 31) to which printing is performed, but also the tape 10 (the transparent film tape 51 to which the double-coated adhesive tape 52 is affixed) correspond to the tape of the disclosure. In a case where the cassette of the disclosure is a receptor tape cassette such as the first cassette, the tape of the disclosure may be the tape 12 (the roll of the tape 12) to which printing is performed. In a case where the cassette of the disclosure is a thermal type cassette, the tape of the disclosure may be a heat sensitive tape or a stencil tape (a roll of a heat sensitive tape or a stencil tape) to which printing is performed.

Further, the rigidity of the transparent film tape 51 may be higher than the rigidity of the double-coated adhesive tape 52. In the latter case, the tape may be curled rightward (in the direction of the arrow C1) at the position frontward of the ejecting portion 73 as extending downstream in the conveying direction.

Further, in the above-described embodiment, the ejecting portion 73 is positioned downstream of the tape drive roller 72 in the conveying direction. However, the ejecting portion 73 may be positioned upstream of the tape drive roller 72 in the conveying direction. For example, the ejecting portion 73 may be positioned at the second tape guide 82. In the latter case, the guide 150 is provided at the second tape guide 82.

Further, in the above-described embodiment, the guide 150 is positioned at the ejecting portion 73 constituting the conveying passage. However, the guide 150 may be positioned at the tape conveying passage in a region from the second tape guide 82 to the ejecting portion 73.

Further, in the above-described embodiment, the base-protrusion 165 is positioned at the center portion of the guide 150 in the upward/downward direction. However, the position of the base-protrusion 165 may be varied.

Further, in the above-described embodiment, the base-protrusion 165 has a trapezoidal shape as viewed in the frontward/rearward direction and in the upward/downward direction. However, the shape of the base-protrusion 165 may be changed to a lob or bowl shape. In any case, the base-protrusion 165 has a center portion and end portions in the upward and downward direction, the center portion having a height in the leftward/rightward direction higher than that of the end portions. Here, the term "height" represents a height (length) in the curving direction, i.e., in the direction from the first surface 10A toward the second surface 10B of the tape 10.

Incidentally, the base-protrusion 165 serves as an example of a protrusion for defining the curving direction of the tape 10 positioned between the extension portions 157A and 157B. Due to the provision of the protrusion between the extension portions 157A and 157B, the cassette 7 can therefore guide the tape 10 against the inherent curling nature of the tape 10. Therefore, the cassette 7 can linearly eject the tape 10.

Further, the base-protrusion 165 may be omitted. In this case, the tape 10 can be deformed in the leftward/rightward direction as long as the distance M between the guide regions 154A and 154B is smaller than the widthwise length of the tape 10. Hence, the tape 10 can be guided in a curved manner against the inherent curling nature of the tape 10. Thus, the cassette 7 can eject the tape 10 whose curling nature is cured or corrected.

Figure 6:
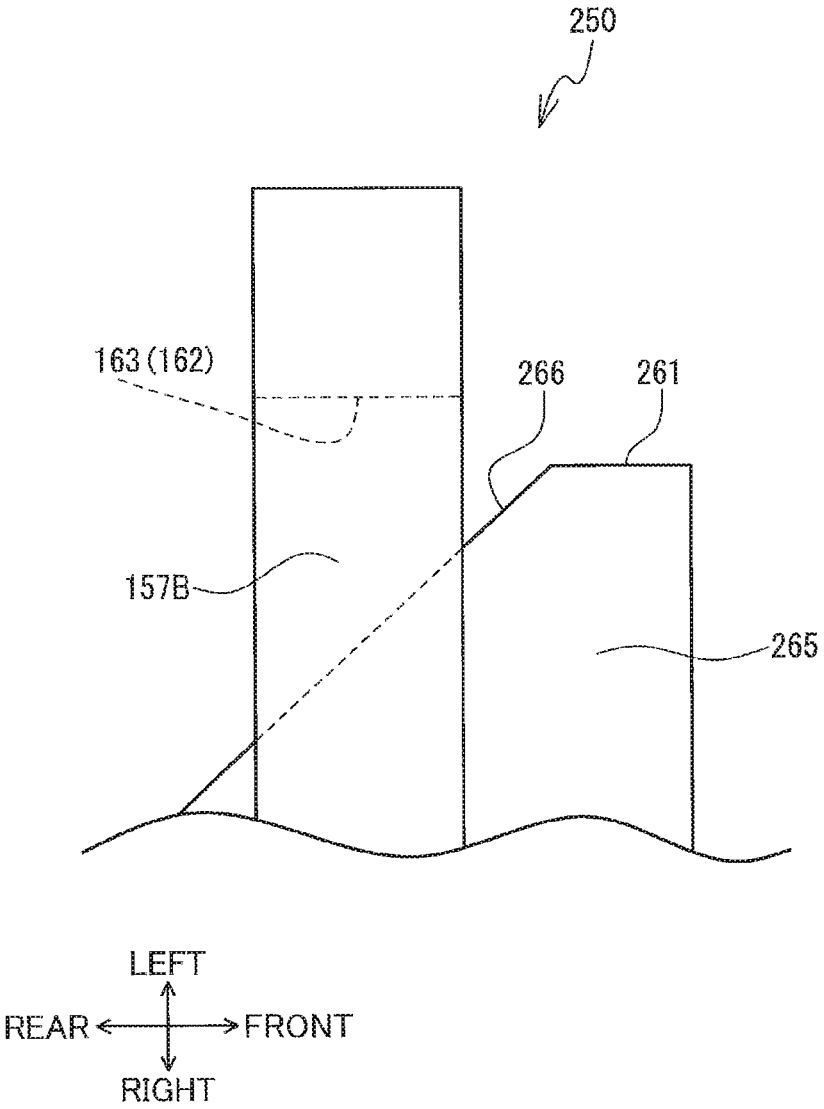
FIG. 6 is a bottom view illustrating a guide 250 according to a first modification to the guide 150 of the embodiment.

A guide 250 according to a first modification to the embodiment will next be described with reference to FIG. 6, wherein like parts and components are designated by the same reference numerals as those shown in FIGS. 1 through 5. The same is true with respect to second through fourth modifications described later.

The guide 250 includes a base-protrusion 265 instead of the base-protrusion 165 (FIG. 5). The base-protrusion 265 extends in the upward/downward direction, and has a flat left end surface 261 functioning as a first region 261. The first region 261 is positioned rightward of the second region 162 and the third region 163.

The first region 261 in its entirety is positioned downstream of the second region 162 and the third region 163 in the conveying direction. In other words, the base-protrusion 265 has a part positioned offset from each of the second region 162 and the third region 163 in the conveying direction. The base-protrusion 265 also has a sloped region 266. The sloped region 266 is a sloped surface connected to an upstream end of the first region 261 in the conveying direction. The sloped region 266 is inclined toward the second region 162, that is, inclined relative to the conveying direction to extend in the curving direction (leftward) toward downstream in the conveying direction (frontward).

According to the first modification, a contacting area of the tape 10 with the guide 250 is elongated in the conveying direction. Therefore, an increased contacting area between the tape 10 and the guide 250 can be provided. Hence, the tape 10 is further less likely to come off the guide 250. Accordingly, the tape 10 can be properly discharged.

Figure 7:
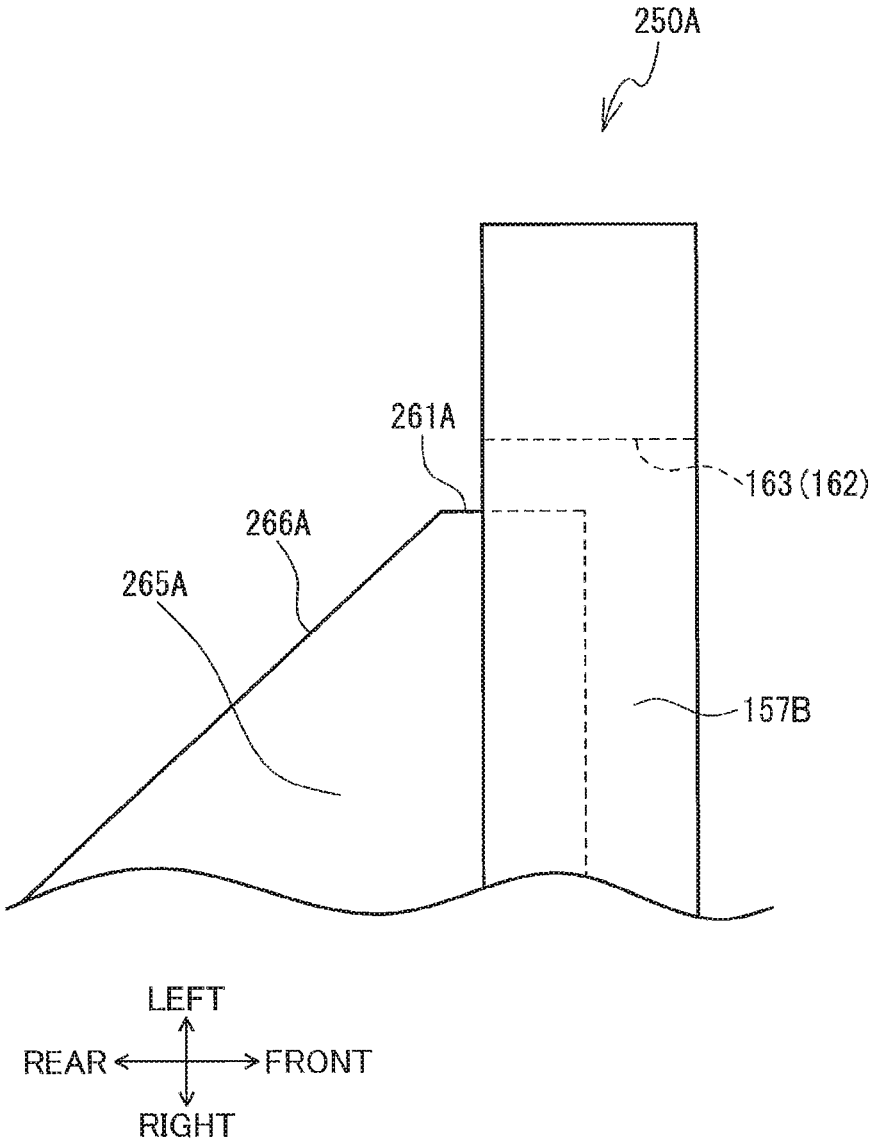
FIG. 7 is a bottom view illustrating a guide 250A according to a second modification to the guide 150 of the embodiment.

A guide 250A according to the second modification to the embodiment will be described with reference to FIG. 7.

The guide 250A is similar to the guide 250 of the first modification except a base-protrusion 265A. The guide 250A includes the base-protrusion 265A, instead of the base-protrusion 265 (FIG. 6). The base-protrusion 265A has a flat left end surface 261A functioning as a first region 261A. The first region 261A has a rear end portion positioned upstream of the second region 162 and the third region 163 in the conveying direction. The first region 261A has a front end portion overlapped with the second region 162 and the third region 163 in the conveying direction (frontward/rearward direction). The base-protrusion 265A also has a sloped region 266A. The sloped region 266A is a sloped surface connected to an upstream end of the first region 261A in the conveying direction. The sloped region 266A is inclined toward the second region 162, that is, inclined relative to the conveying direction to extend in the curving direction (leftward) toward downstream in the conveying direction (frontward).

According to the second modification, the rear end portion of the first region 261A is positioned upstream of the second region 162 and the third region 163 in the conveying direction. In other words, the base-protrusion 265A has a portion positioned offset from each of the second region 162 and the third region 163 in the conveying direction. More specifically, this portion of the base-protrusion 265A is positioned upstream of the second and third regions 162 and 163 in the conveying direction. In a case where the tape 10 is released or disengaged from the ejecting portion 73, resetting of the tape 10 at the ejecting portion 73 by the user is required. However, according to the guide 250A of the second modification, a leading edge of the tape 10 (most downstream end of the tape 10) is initially easily contacted with the sloped region 266A, and then, easily contacted with the first region 261A. Accordingly, the tape 10 can be easily guided by the second region 162 and the third region 163. As a result, the tape 10 disengaged from the ejecting portion 73 can again be positioned at the ejecting portion 73. Consequently, the tape 10 can be properly discharged.

Figure 8:
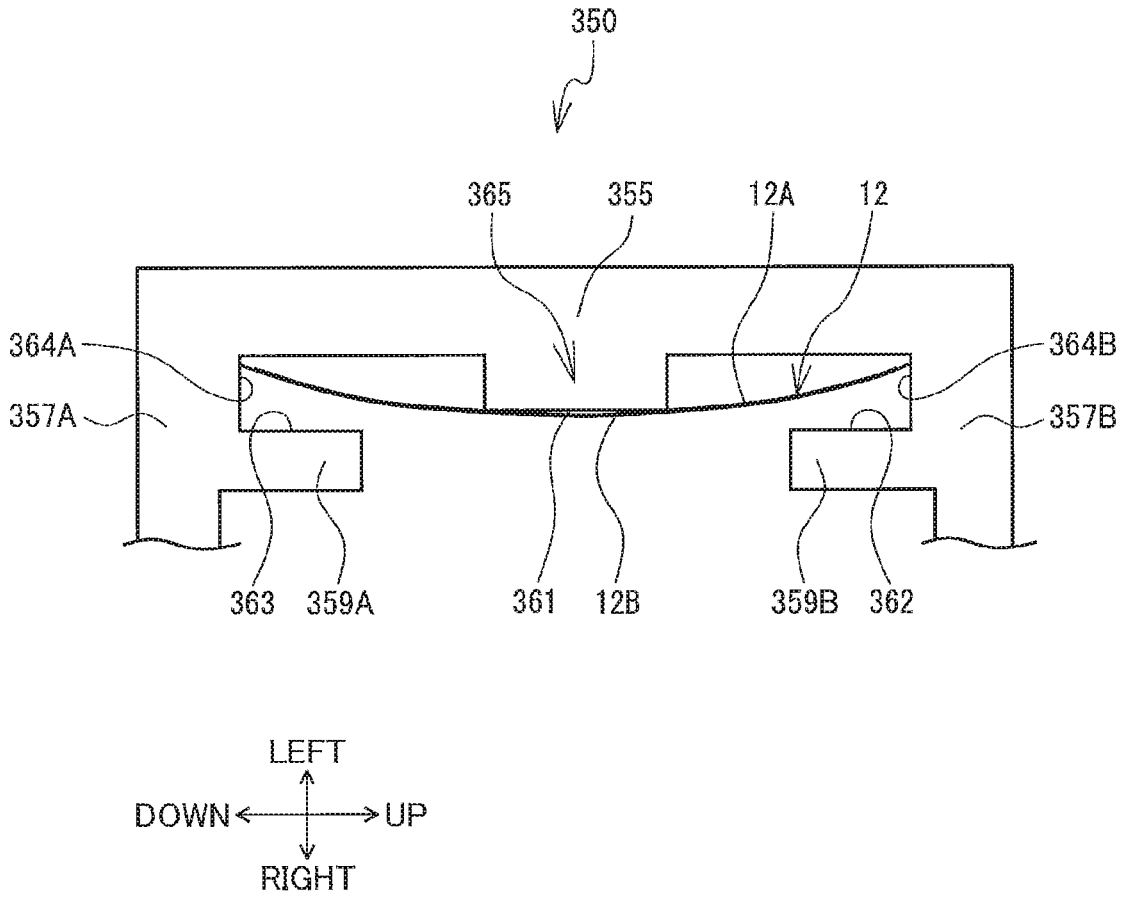
FIG. 8 is a front view illustrating a guide 350 according to a third modification to the guide 150 of the embodiment.

A guide 350 according to the third modification to the embodiment will be described with reference to FIG. 8.

The guide 350 is provided at the ejecting portion 73 (FIG. 4). The guide 350 is one of the components of the receptor type cassette (first cassette) using the receptor tape (the tape 12).

The guide 350 includes a base 355, abase-protrusion 365, a pair of extension portions 357A and 357B, and a pair of arms 359A and 359B. The base 355 extends in the upward/downward direction. The base-protrusion 365 protrudes rightward from a generally center portion of the base 355 in the upward/downward direction. The base-protrusion 365 has a flat right end surface serving as a flat first region 361. Each of the pair of extension portions 357A, 357B extends rightward from each end portion in the upward/downward direction of the base 355. The extension portions 357A and 357B respectively have flat end surfaces 364A and 364B facing each other in the upward/downward direction. These end surfaces 364A and 364B serve as flat guide regions 364A and 364B, respectively.

The arms 359A and 359B extend toward each other in the upward/downward direction. The upper arm 359B has a left end surface 362 serving as a second region 362, and the lower arm 359A has a left end surface 363 serving as a third region 363. The second region 362 and the third region 363 are flat surfaces. The first region 361 is positioned leftward of the second region 362 and the third region 363.

Widthwise edges of the tape 12 (the upper and lower edges of the tape 12) are guided by the flat guide regions 364A and 364B. The tape 12 has a left end surface (first surface 12A) in contact with the first region 361. The tape 12 has a right end surface (second surface 12B) opposite the first surface 12A. In the third modification, the curving direction of the tape 12 is rightward, which is coincident with the direction from the first surface 12A toward the second surface 12B of the tape 12. Further, the second surface 12B (the right end surface) of the tape 12 face the second region 362 and the third region 363. With this structure, rightward displacement of the tape 12 can be restricted by the contact of the second surface 12B with the second region 362 and the third region 363.

According to the third modification, the second surface 12B is the surface on which printing is performed by the thermal head 60. The second surface 12B of the tape 12 is less likely to contact the second region 362 and the third region 363 both of which are positioned above and below the first region 361. Therefore, blurred character printing on the second surface 12B can be avoided.

Figure 9:
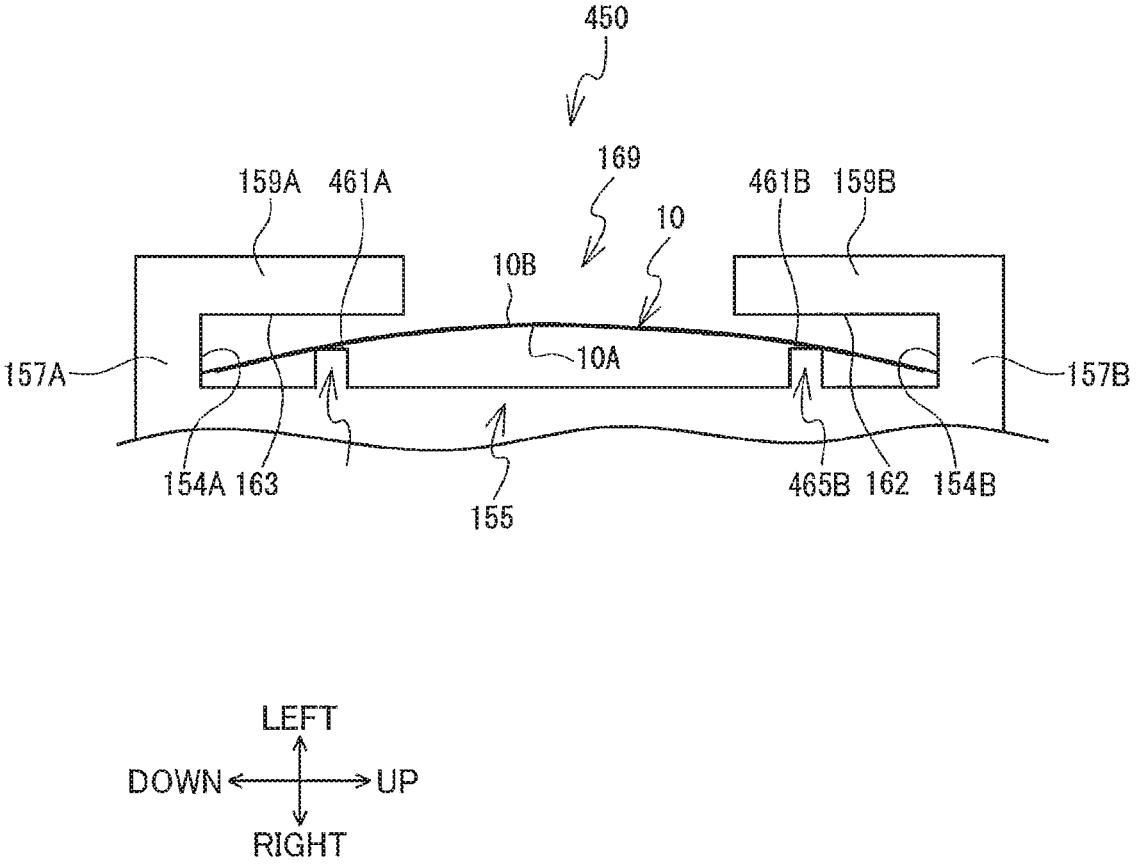
FIG. 9 is a front view illustrating a guide 450 according to a fourth modification to the guide 150 of the embodiment.

A guide 450 according to the fourth modification to the embodiment will be described with reference to FIG. 9.

The fourth modification is different from the embodiment in that a pair of base-protrusions 465A and 465B are provided instead of the base-protrusion 165. Each of the pair of base-protrusions 465A and 465B protrudes leftward from the base 155. The base-protrusions 465A and 465B are respectively positioned away from a vertical center of the base 155 by a distance generally equal to each other. Each of the pair of base-protrusions 465A and 465B has a left end surface as a first region 461A, 462B. The first regions 461A and 461B are in line with each other in the upward/downward direction. That is, leftward/rightward positions of the first regions 461A and 461B are generally coincident with each other. Further, the upper first region 461B faces the second region 162, and is positioned rightward of the second region 162. The lower first region 461A faces the third region 163, and is positioned rightward of the third region 163.

The first surface 10A of the tape 10 is guided by the first regions 461A and 461B of the pair of base-protrusions 465A and 465B. Therefore, the curving direction in the guide 450 is the leftward direction, i.e., in the direction from the first surface 10A to the second surface 10B. Further, each widthwise edge of the tape 10 is contacted with and guided by the guide region 154A or 154B. Hence, the guide 450 can deform the tape 10 to be convex in the curving direction (leftward). Thus, the tape 10 can be linearly discharged toward the discharge opening 11 against the inherent curling nature of the tape 10. Incidentally, instead of the pair of base-protrusions 465A and 465B, three or more protrusions may be provided.

While the description has been made in detail with reference to the specific embodiment and modifications thereof, it would be apparent to those skilled in the art that various changes and further modifications may be made therein without departing from the scope of the above described embodiment.

<Remarks>

The ejecting portion 73, the first tape guide 81, and the second tape guide 82 are an example of a tape conveying passage. The lower extension portion 157A is an example of a first guide. The upper extension portion 157A is an example of a second guide. The lower guide region 154A is an example of a first end surface. The upper guide region 154B is an example of a second end surface. The base-protrusions 165, 265, 265A, 465A and 465B are examples of a protrusion a third guide. The first regions 161, 261, 261A, 461A and 461B are examples of a contact-guide region. The sloped regions 166, 266 and 266A are an example of a sloped region. The lower arm 159A is an example of a fourth guide. The upper arm 159B is an example of a fifth guide. The tape 10 and the tape 12 are examples of a tape. The double-coated adhesive tape 52 is an example of a first tape. The transparent film tape 51 is an example of a second tape. The upward/downward direction is an example of a first direction. The frontward/rearward direction is an example of a second direction. The leftward direction is an example of a curving direction and an example of a third direction.

What is claimed is:

1. A cassette comprising:

a tape roll rotatable about an axis extending in a first direction, the tape roll being a roll of a tape, and the tape having a widthwise length in the first direction in a state of the tape roll, the tape having a first surface and a second surface opposite the first surface;

a tape conveying passage along which the tape is configured to be conveyed in a second direction perpendicular to the first direction;

a first guide positioned at the tape conveying passage and configured to guide one widthwise edge of the tape in the first direction, the first guide having a first end surface; and a second guide positioned at the tape conveying passage and configured to guide another widthwise edge of the tape in the first direction, the second guide having a second end surface facing the first end surface in the first direction, wherein the first end surface and the second end surface provide a distance therebetween in the first direction smaller than the widthwise length of the tape.

2. The cassette according to claim 1, further comprising a protrusion positioned at the tape conveying passage and between the first guide and the second guide in the first direction, the protrusion defining a curving direction of the tape that is conveyed at a position between the first end surface and the second end surface.

3. The cassette according to claim 1, further comprising a third guide positioned between the first guide and the second guide in the first direction, the third guide having a contact-guide region configured to guide the first surface of the tape, wherein the third guide has a center region and end regions in the first direction, the center region having a length greater than a length of each of the end regions in a third direction perpendicular to the first direction and the second direction, the center region including the contact-guide region.

4. The cassette according to claim 3, further comprising a fourth guide positioned at the tape conveying passage and configured to guide the second surface of the tape, the fourth guide being positioned offset from the third guide in a third direction perpendicular to the first direction and the second direction.

5. The cassette according to claim 4, wherein the fourth guide is also offset from the third guide in the first direction.

6. The cassette according to claim 3, further comprising:

a fourth guide positioned at the tape conveying passage and configured to guide the second surface of the tape; and a fifth guide positioned at the tape conveying passage and configured to guide the second surface of the tape, the fourth guide and the fifth guide being spaced away from each other in the first direction.

7. The cassette according to claim 6, wherein the third guide has a portion positioned offset from each of the fourth guide and the fifth guide in the second direction.

8. The cassette according to claim 7, wherein the portion of the third guide is positioned upstream of the fourth guide and the fifth guide in the second direction.

9. The cassette according to claim 7, wherein the portion of the third guide is positioned downstream of the fourth guide and the fifth guide in the second direction.

10. The cassette according to claim 6, wherein the first end surface and the second end surface are configured to contact the one widthwise edge and the another widthwise edge of the tape, respectively, and Wherein the first guide is connected to the fourth guide, and the second guide is connected to the fifth guide.

11. The cassette according to claim 6, wherein the fourth guide and the fifth guide are arrayed with each other with a space therebetween in the first direction, the space being open in a third direction defined as a direction from the first surface to the second surface of the tape that is conveyed between the first end surface and the second end surface.

12. The cassette according to claim 3, wherein the third guide comprises a sloped region connected to an upstream edge of the contact-guide region in the second direction, and wherein the sloped region is sloped to extend in the third direction toward downstream in the second direction, the third direction being a direction from the first surface to the second surface of the tape that is conveyed at a position between the first end surface and the second end surface.

13. The cassette according to claim 1, wherein the second surface is an inner surface of a curl of the tape, the curl being an inherent nature originated from a rolled shape of the tape roll.

14. The cassette according to claim 1, wherein the tape comprises:

a. first tape having an adhesive surface; and a second tape to which the first tape is stuck, the second tape having a widthwise length greater than a widthwise length of the first tape in the first direction.

15. The cassette according to claim 14, wherein the tape is deformed to be a convex shape such that the second tape is at an outer side of the convex shape.

16. The cassette according to claim 14, wherein the second tape has a surface to be printed.

17. The cassette according to claim 14, further comprising:

a first tape spool from which the first tape is configured to be paid out, the first tape having a first rigidity; and a second tape spool from which the second tape is configured to be paid out, the second tape paid out from the second tape spool being overlapped with the first tape, the second tape having a second rigidity, wherein the second surface is a surface of the first tape in a case where the first rigidity is lower than the second rigidity, and wherein the second surface is a surface of the second tape in a case where the second rigidity is lower than the first rigidity.

18. The cassette according to claim 1, further comprising a case formed with a head opening in which a thermal head of a printing device is insertable, wherein the first guide and the second guide are positioned downstream of the head opening in the second direction.

19. The cassette according to claim 1, further comprising:

a case; and an ejecting portion provided at the case and constituting a part of the tape conveying passage, the tape being configured to be ejected out of the case through the ejecting portion, wherein the first guide and the second guide are positioned at the ejecting portion.

* * * * *